United States Patent [19]

Archer

[11] 4,369,418

[45] Jan. 18, 1983

[54] DEFLECTION YOKE INCORPORATING A PERMEABLE CORRECTOR

[75] Inventor: John R. Archer, Carmel, Ind.

[73] Assignee: RCA Corporation, New York, N.Y.

[21] Appl. No.: 379,419

[22] Filed: May 18, 1982

Related U.S. Application Data

[63] Continuation of Ser. No. 215,002, Dec. 10, 1980, abandoned.

[51] Int. Cl.[3] ..... H01F 3/12

[52] U.S. Cl. ..... 335/211; 335/210

[58] Field of Search ..... 335/211, 212, 213, 210, 335/214

[56] References Cited

U.S. PATENT DOCUMENTS 2,494,459 1/1950 Torsch ..... 335/211

3,027,500 3/1962 Smith ..... 335/213

*Primary Examiner*—Harold Broome

*Attorney, Agent, or Firm*—Eugene M. Whitacre; Paul J. Rasmussen; Scott J. Stevens

[57] ABSTRACT

In a color television display system comprising a kinescope having in-line electron beams and a deflection yoke having saddle horizontal and toroidal vertical windings, a correcting apparatus comprises a magnetically permeable ring disposed at the rear of the yoke around the neck of the kinescope. Slots are formed into the ring at the top and bottom, separating it into two semi-circular segments. External flux from the deflection yoke horizontal and vertical coils is shunted into the permeable corrector and away from the focus region of the kinescope electron gun assembly, thereby improving beam focus and reducing vertical coma error. The slots formed in the ring prevent excessive flux from being shunted into the corrector which otherwise would undesirably reduce the amount of beam scan, and require a compensating increase in deflection power.

7 Claims, 4 Drawing Figures

DEFLECTION YOKE INCORPORATING A PERMEABLE CORRECTOR

This is a continuation of application Ser. No. 215,002, filed Dec. 10, 1980, now abandoned.

This invention relates to color television deflection yokes, and in particular to the use of magnetically permeable correctors in conjunction with such yokes.

A color television picture tube or kinescope produces three electron beams which strike particular color-emitting phosphor elements on a display screen. A deflection yoke is mounted on the kinescope and produces time-variant magnetic fields in the vicinity of the electron beams, causing them to be scanned across the display screen horizontally and vertically to produce a lighted raster. It is desired that each beam strike only phosphor elements of a particular color-emitting designation. The extent to which this occurs determines the purity of the raster. It is also important that the beams strike the display screen in close proximity to each other at all points on the display screen; that is, it is important that the beams converge at the screen.

The predominant number of color kinescopes produce electron beams having one of two configurations. One type produces beams arranged in a triangular or "delta" configuration while the other type produces the beams in a horizontal in-line pattern. Delta gun tubes require dynamic convergence circuitry to converge the beams during deflection. In-line tubes, however, allow the construction of a deflection yoke which substantially converges the electron beams at all points on the kinescope display screen without the need for dynamic convergence circuitry.

These self-converging yokes for in-line tubes provide electron beam convergence by the nature of the deflection field nonuniformity produced by the particular configuration of the deflection coils. Third order aberration theory explains that an overall net pincushion-shaped field must be produced by the horizontal deflection coils and an overall net barrel-shaped field must be produced by the horizontal deflection coils and an overall net barrel-shaped field must be produced by the vertical deflection coils in order to realize beam convergence. Techniques for winding deflection yoke coils to produce desired field nonuniformities are known.

Deflection yokes may be made which have coils toroidally-wound about a magnetically permeable core, saddle-type coils or a combination of the two. A popular type yoke comprises saddle-wound horizontal coils and toroidally-wound vertical coils. Both saddle-wound and toridally-wound coils produce external fields at the sides and rear of the yoke in addition to the main deflection fields produced within the interior region of the yoke. The external field at the rear of the yoke produced by a toroidally-wound coil, however, is of the order of five times greater than the external field formed by a saddle coil. The presence of these external fields at the rear of the yoke may undesirably affect the electron beams within the focusing region of the kinescope electron gun assembly. Premature deflection of the beams may occur, which may cause noticeable defocussing of the beams at some display screen locations. For a yoke having toroidal vertical coils and saddle horizontal coils, the external vertical field provides the greatest undesirable effects.

An additional problem occurs with self-converging yokes. Although a barrel-shaped vertical field is necessary for convergence of the electron beams, the barrel-shaped field causes a greater deflection of the outer beams than the center beam, resulting in a condition of vertical coma, in which the center beam raster is reduced in height with respect to the outer beam rasters. It is known from third order aberration theory that vertical coma errors are most sensitive to field nonuniformity at the beam entrance end or rear of the yoke. The barrel-shaped external field from the vertical deflection coils, therefore, greatly contributes to vertical coma error.

One solution to the problem of beam defocussing due to external deflection fields is to manufacture a portion of the electron gun assembly of a magnetically permeable material to shunt the external fields away from the focussing region of the gun. This technique may in fact distort the shape of the external field to the point where a degradation of beam convergence occurs. U.S. Pat. No. 3,430,169—Gabor illustrates the use of a magnetically permeable ring around the tube neck in the gun focussing region to "short circuit" the external field. This "short circuiting" may cause an undesirable weakening of the deflection field, leading to a reduction in beam scan, therefore, requiring an increase in deflection power.

The present invention provides a means for reducing the effect of the external deflection fields on the electron beams in the gun focussing region while providing a correction of vertical coma error. In accordance with the present invention, a correcting apparatus is provided for use in a color television display system comprising a kinescope having a neck and a display screen and incorporating an electron gun assembly for producing three horizontally aligned electron beams. A deflection yoke is mounted on the kinescope neck and encircles the beams. The yoke incorporates horizontal and vertical deflection coils for deflecting the beams across the kinescope display screen. The deflection coils produce a main deflection field and an external field. The correcting apparatus comprises a magnetically permeable ring disposed at the rear of the yoke with the external fields. Flux from the external fields is shunted into the ring. A vertically oriented slot is formed in the ring, with the width of the slot being a small fraction of the kinescope neck diameter. The slot interrupts the flow of flux through the ring.

In the accompanying drawing.

Figure 1:
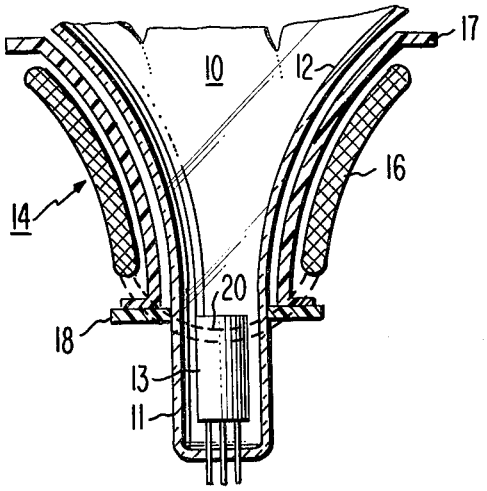
FIG. 1 is a top cross-sectional view of a color television display system, illustrating the spatial relationship between the deflection yoke external field and the kinescope electron gun assembly.
Figure 2:
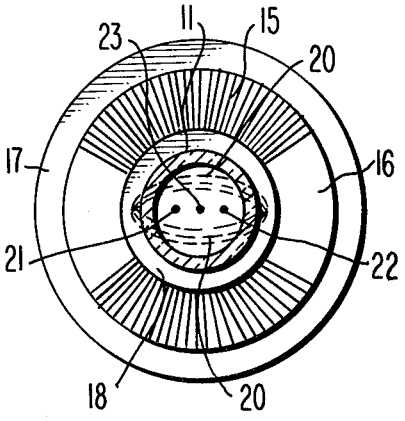
FIG. 2 is a rear cross-sectional view of the display system shown in FIG. 1, illustrating the vertical coil external field.

Referring to FIGS. 1 and 2, there is shown a color television display system comprising a kinescope 10 having a neck region 11, a funnel region 12 and a phosphor display screen (not shown) at the opposite end of the kinescope from neck region 11. An electron gun assembly 13 is located within neck region 11 and performs the function of generating, accelerating and focussing three electron beams. In the display system shown in FIG. 1, the three electron beams are arranged in a horizontal in-line configuration. A deflection yoke 14 is mounted on kinescope 10 in the area where the neck region 11 joins the funnel region 12. Deflection yoke 14 comprises a pair of horizontal deflection coils (not shown), wound in a saddle-type configuration and a pair of vertical deflection coils 15 (shown in FIG. 2) toroidally-wound about a magnetically permeable core 16. A plastic insulator 17 separates the horizontal and vertical coils. A mounting plate 18 is mounted to the insulator 17 at the rear of yoke 14. Mounting plate 18 may incorporate a clamp to facilitate securing yoke 14 to kinescope 10 after the yoke has been properly adjusted in rotational and axial position.

FIG. 1 illustrates the external field produced by the vertical deflection coils of yoke 14, as represented by field lines 20. As shown in FIG. 1, the external field exists in a region occupied by a portion of the electron gun assembly 13. This field causes a slight deflection of the beams within the electron gun assembly, which may result in a degradation in the focus of the beams. Construction of a desirably short kinescope aggravates this problem by placing the electron gun assembly close to the rear of the deflection yoke and, therefore, within the yoke external fields.

FIG. 2 illustrates a rear view of the yoke. Field lines 20 of the external field are shown in a barrel-shape configuration, representing the external field of the vertical deflection coils. The barrel-shape of the field results from the expansion of the field due to repelling between field lines between the concentrated ends of the field. Since the external toroidal vertical field is of the order of five times greater than the external saddle horizontal field, the external vertical field will have a much greater influence on the electron beams than the external horizontal field. The external field of the horizontal saddle coils, though not totally insignificant, does not produce an appreciable effect on the beams. Therefore, only the external vertical field is shown in FIG. 2.

In addition to its effect on the focus of the electron beams, the external vertical field as shown in FIG. 2 may cause a problem resulting from the nonuniform character of the shape of the field. The barrel-shape external vertical field exerts a greater deflection force on the outer electron beams 21 and 22 than on the center beam 23, since the field lines 20 are least concentrated along the vertical axis through the kinescope neck. This increased vertical deflection of the outer beams 21 and 22 with respect to the center beam 23 results in vertical coma error; that is, where the center beam raster is reduced in height with respect to the height of the outer beam rasters.

Figure 3:
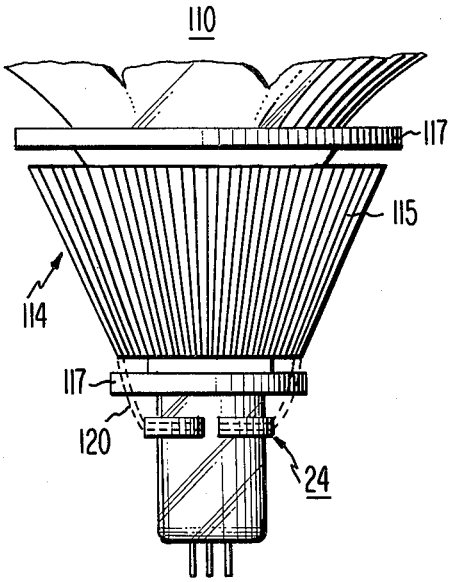
FIG. 3 is a top plan view of a color television display system illustrating a correcting apparatus in accordance with the present invention.
Figure 4:
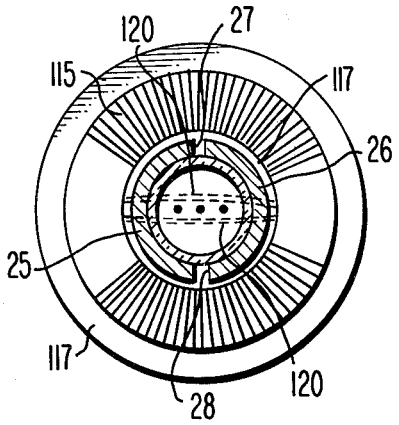
FIG. 4 is a rear cross-sectional view of the display system of FIG. 3, illustrating a feature of the correcting apparatus.

FIGS. 3 and 4 illustrate a color television display system comprising a kinescope 110 and a deflection yoke 114 similar to that shown in FIG. 1. Toroidally-wound vertical deflection coils 115 are shown, as well as the plastic insulator 117. A correction apparatus 24 is shown mounted to the kinescope neck, in the vicinity of the focussing region of the electron gun assembly. Corrector 24 is made of a magnetically permeable material, and therefore, presents a lower reluctance path to magnetic flux than does air. A portion of the flux from the external deflection fields is, therefore, shunted into corrector 24, as seen in FIG. 3. By action of this flux from the external deflection fields being shunted into corrector 24, the remaining flux within the tube neck is less concentrated. The decrease in flux concentration results in less interaction between the external field and the electron beams, which results in less coma error. Coma error is also decreased by action of permeable corrector 24 constraining the boundary of the external field, especially at the top and bottom of the tube neck, which causes the field lines within the tube neck to flatten somewhat. This flattening causes the field to become less barrel-shaped, resulting in a decrease in coma error.

Corrector 24 comprises a pair of semi-circular ring segments 25 and 26, which are separated by slots 27 and 28 at the top and bottom of corrector 24. The separation distances or slot widths are a small fraction of the diameter of the ring, which encircles the kinescope neck, but are important for the following reasons. The segment separation provides a break in the low reluctance path of the corrector segments 25 and 26, thereby increasing the overall path reluctance somewhat. This increased reluctance causes less flux to be shunted through corrector 24 than would be the case if the corrector were a complete ring. Although it is desirable to remove the external field from the beam focussing region, the external deflection field at other locations aids in deflection of the beams, thereby reducing the deflection and, therefore, power needed by the main deflection fields. If corrector 24 were a complete ring, a substantial amount of the desirable external field would be shunted into corrector 24, resulting in a beam scan reduction which would necessitate an increase in deflection power as a compensation. The separation between segments 25 and 26 allows sufficient flux from the external fields to be shunted into corrector 24 to improve beam focus and reduce coma error, but prevents an unnecessary amount of flux to be shunted which could cause an undesirable reduction in scan.

The segment separations are located along the kinescope vertical axis, such that they present a break in the path of the vertical field flux. This orientation is a result of the relative difference between the horizontal and vertical external fields, as previously described. The segments do interrupt, somewhat, the flow of the horizontal flux which would otherwise circulate through corrector 24.

What is claimed is:

1. In a self-converging deflection yoke for use with a color kinescope producing three horizontal in-line electron beams, said yoke incorporating horizontal and vertical deflection coils producing nonuniform fields for deflecting and converging said beams; said coils producing a main deflection field and an external field; said nonuniform fields causing unequal deflection of said beams resulting in vertical coma errors between the rasters scanned by said beams in the absence of correction therefor; a vertical coma correcting apparatus comprising:

a magnetically permeable ring disposed at the rear of said yoke within said external field for shunting the flux from said external field into said ring, thereby modifying said nonuniform fields to control the deflection of at least one of said three beams with respect to another of said beams to correct said coma errors, said ring having a slot formed therein, and said slot being a small fraction of the diameter of said ring for interrupting the flow of magnetic flux through said ring.

2. The arrangement defined in claim 1, wherein said slot is located in the top portion of said ring along the vertical axis of said yoke, and wherein said ring incorporates a second slot located in the bottom portion of said ring along said yoke vertical axis.

3. The arrangement defined in claim 2, wherein said horizontal deflection coils are saddle-wound and said vertical deflection coils are toroidally-wound.

4. The arrangements defined in claim 2, wherein the width of said slots determines the reluctance of the flux path through said ring.

5. The arrangement defined in claim 1 wherein said external field has a barrel-shaped cross-section and said ring reduces the strength of said barrel field for correcting vertical coma errors between said electron beams.

6. The arrangement defined in claim 5 wherein said ring shunts a portion of said external field away from said electron beams.

7. In a self-converging deflection yoke for use with a color kinescope producing three horizontal in-line electron beams, said yoke incorporating saddle-type horizontal deflection coils and toroidally wound vertical deflection coils producing nonuniform fields for deflecting and converging said beams; said coils each producing a main deflection field and an external leakage field; said vertical deflection coils producing a substantially greater leakage field than said horizontal coils; said nonuniform fields causing unequal deflection of said beams resulting in vertical coma errors between the rasters scanned by said beams in the absence of correction therefor; a vertical coma correcting apparatus comprising:

a magnetically permeable ring disposed at the rear of said yoke within said external fields for shunting the flux primarily from said external leakage field produced by said vertical deflection coils into said ring, thereby modifying said nonuniform fields to control the deflection of at least one of said three beams with respect to another of said beams to correct said vertical coma errors, said ring having a slot formed therein, and said slot being a small fraction of the diameter of said ring, for interrupting the flow of magnetic flux through said ring.

* * * * *